US012690681B2

(12) United States Patent
Cai et al.

(10) Patent No.: US 12,690,681 B2
(45) Date of Patent: Jul. 28, 2026

(54) MOVABLE SEATING DEVICE AND MECHANICAL EXTENSION DEVICE THEREOF

(71) Applicant: REMACRO TECHNOLOGY CO., LTD., Suzhou (CN)

(72) Inventors: Saijun Cai, Suzhou (CN); Xiaohong Li, Suzhou (CN); Yuankun Li, Suzhou (CN); Zhanzheng Lv, Suzhou (CN)

(73) Assignee: REMACRO TECHNOLOGY CO., LTD., Suzhou (CN)

( * ) Notice: Subject to any disclaimer, the term of this patent is extended or adjusted under 35 U.S.C. 154(b) by 255 days.

(21) Appl. No.: 18/786,425

(22) Filed: Jul. 26, 2024

(65) Prior Publication Data

US 2025/0000260 A1 Jan. 2, 2025

Related U.S. Application Data

(63) Continuation of application No. PCT/US2023/137475, filed on Dec. 8, 2023.

(30) Foreign Application Priority Data

Jun. 30, 2023 (CN) ..... 202310792274.8
Sep. 8, 2023 (CN) ..... 202311159590.8

(51) Int. Cl.
*A47C 1/032* (2006.01)
*A47C 1/034* (2006.01)

(52) U.S. Cl.
CPC ..... *A47C 1/032* (2013.01); *A47C 1/0345* (2013.01)

(58) Field of Classification Search
CPC ..... A47C 1/032; A47C 1/0345
See application file for complete search history.

(56) References Cited

U.S. PATENT DOCUMENTS

| | | | | |
|---|---|---|---|---|
| 5,772,278 | A * | 6/1998 | Kowalski | A47C 1/0355 297/85 L |
| 7,497,512 | B2 * | 3/2009 | White | A47C 1/0355 297/89 |
| 8,419,122 | B2 * | 4/2013 | Lawson | A47C 1/035 297/259.2 |
| 2012/0299363 | A1 * | 11/2012 | Crum | A47C 1/0355 297/85 M |
| 2018/0242740 | A1 * | 8/2018 | Lawson | A47C 1/0345 |

* cited by examiner

*Primary Examiner* — Anthony D Barfield
(74) *Attorney, Agent, or Firm* — Arch & Lake LLP

(57) ABSTRACT

Provided is a seating device including an armrest, a seat, a backrest, an ottoman, and a mechanical extension device including a seat frame attached to the seat, a backrest assembly including a backrest bracket; a leg extension device. The mechanical extension device is configured to move the seating device from a first position to a second position. The backrest assembly includes a backrest bracket, a first backrest link, and a second backrest link, the backrest bracket is configured to attach the backrest, the first backrest link is pivotally connected to a front end of the backrest bracket at a first pivot point, the first backrest link is pivotally connected to the seat frame at a second pivot point, and the first pivot point has a trajectory that moves towards the leg extension device in the process of moving the seating device from the sitting position to the reclining position.

20 Claims, 6 Drawing Sheets

MOVABLE SEATING DEVICE AND MECHANICAL EXTENSION DEVICE THEREOF

CROSS-REFERENCE TO RELATED APPLICATIONS

The present application is a continuation application of PCT application No. PCT/US2023/137475 filed on Dec. 8, 2023, which is based upon and claims priority to Chinese Patent Application No. 202310792274.8 filed on Jun. 30, 2023 and Chinese Patent Application No. 202311159590.8 filed on Sep. 8, 2023, the entire disclosures of which are incorporated herein by reference for all purposes.

BACKGROUND

Various types of movable seats are known in the prior art, such as sofas or chairs with multi-position transformation functions. With the improvement of people's living standards, the demand for comfort of sofas and chairs is also increasing. In known designs, movable seat units typically have mechanical stretching/extension devices, allowing them to transition between folded positions, leisure positions (or TV positions), and lying positions (or reclining positions). When the seat transitions from the folded position to the leisure position, the footrest of the seat unit extends forward, and the angle between the backrest and the seat section remains basically unchanged. When transitioning from the leisure position to the lying position, the footrest further extends forward and upward, and the backrest significantly reclines.

However, as users' demands for comfort increase and the ultimate pursuit of zero wall clearance layouts intensifies, existing designs of movable seats are unable to fully meet users' needs. Particularly because the mechanical structures involve complex connections and require a large number of parts, this not only leads to higher manufacturing costs but also causes stiffness in the mechanical structure's posture transitions. Additionally, these seat units (or seating devices) in the prior art cannot achieve true zero-wall functionality. That is, during the transition from the sitting position to the reclining position, the rear end of the backrest portion moves backward, requiring larger space behind the seat unit. Moreover, during the unfolding process of the seat unit, gaps may appear between the backrest portion and the seat section, causing the user's clothing to be pulled out, which does not meet the user's comfort requirements.

BRIEF SUMMARY

The present disclosure provides examples of techniques relating to improving a seating unit or device with an electrical swinging device or structure, and a method for operating the seating unit or device.

According to a first aspect of the present disclosure, there is provided a seating device including an armrest, a seat, a backrest, an ottoman, and a mechanical extension device. The mechanical extension device includes a seat frame for attaching the seat, a backrest assembly pivotally connected to a rear part of the seat frame. The backrest assembly includes a backrest bracket configured to attach a backrest of the seating device, a leg extension device pivotally connected to a front part of the seat frame, where the leg extension device is configured to attach the ottoman.

Further, the mechanical extension device is configured to move the seating device from a first position to a second position, where the seating device is capable of being in multiple positions including a sitting position and a reclining position. In the sitting position, the ottoman is located under the seat; in the reclining position, the ottoman extends forward and upward, and the backrest tilts backward; in the process of moving the seating device from the sitting position to the reclining position, a rear end of the backrest bracket has no backward directional movement.

Moreover, the backrest assembly includes a backrest bracket, a first backrest link, and a second backrest link, the backrest bracket is configured to attach the backrest, the first backrest link is pivotally connected to a front end of the backrest bracket at a first pivot point, the first backrest link is pivotally connected to the seat frame at a second pivot point, and the first pivot point has a trajectory that moves towards the leg extension device in the process of moving the seating device from the sitting position to the reclining position.

According to a second aspect of the present disclosure, there is provided a mechanical extension device, including a seat frame for attaching a seat of a seating device; a backrest assembly pivotally connected to a rear part of the seat frame, where the backrest assembly includes a backrest bracket configured to attach a backrest of the seating device; a leg extension device pivotally connected to a front part of the seat frame, where the leg extension device is configured to attach an ottoman of the seating device.

Furthermore, the mechanical extension device is configured to move the seating device from a first position to a second position, wherein the seating device is capable of being in multiple positions comprising a sitting position and a reclining position. In the sitting position, the ottoman is located under the seat; in the reclining position, the ottoman extends forward and upward, and the backrest tilts backward; in the process of moving the seating device from the sitting position to the reclining position, a rear end of the backrest bracket has no backward directional movement.

Moreover, the backrest assembly includes a backrest bracket, a first backrest link, and a second backrest link, the backrest bracket is configured to attach the backrest, the first backrest link is pivotally connected to a front end of the backrest bracket at a first pivot point, the first backrest link is pivotally connected to the seat frame at a second pivot point, and the first pivot point has a trajectory that moves towards the leg extension device in the process of moving the seating device from the sitting position to the reclining position.

It is to be understood that both the foregoing general description and the following detailed description are examples only and are not restrictive of the present disclosure.

BRIEF DESCRIPTION OF THE SEVERAL VIEWS OF THE DRAWINGS

The accompanying drawings, which are incorporated in and constitute a part of this specification, illustrate examples consistent with the present disclosure and, together with the description, serve to explain the principles of the disclosure.

DETAILED DESCRIPTION

Figure 1:
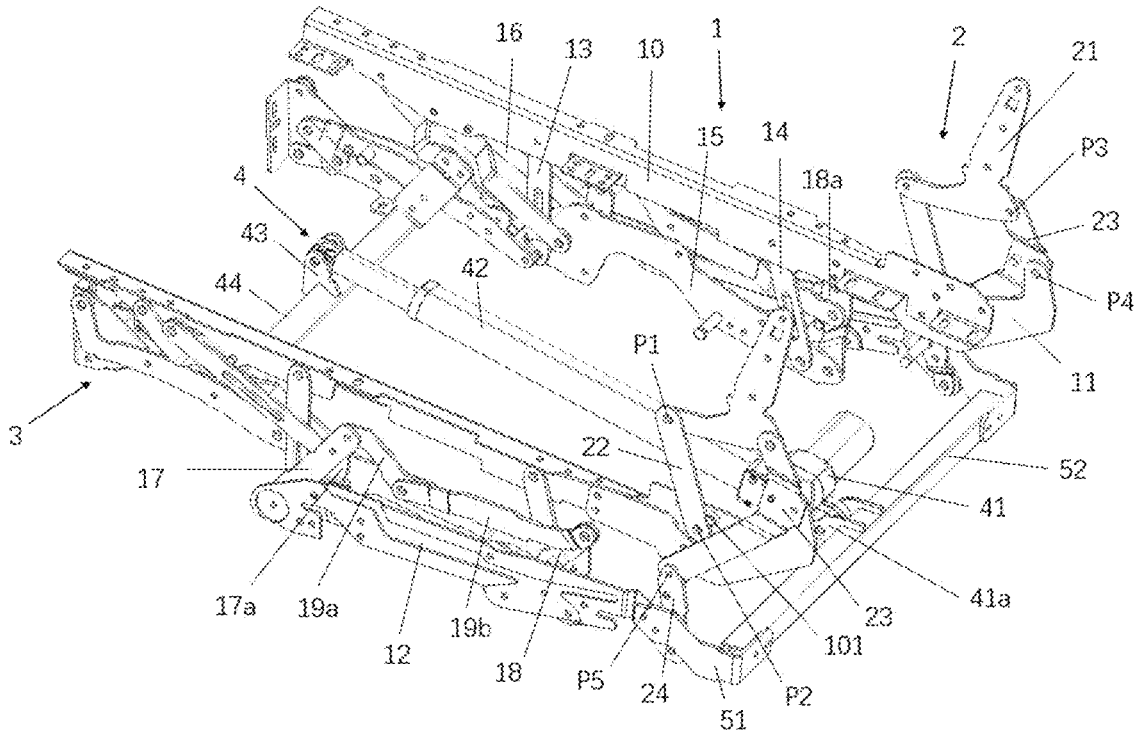
FIG. 1 illustrates a perspective view of a mechanical extension device applied in a movable seating device in a sitting position according to some examples of the present disclosure.

Reference will now be made in detail to specific implementations, examples of which are illustrated in the accompanying drawings. In the following detailed description, numerous non-limiting specific details are set forth in order to assist in understanding the subject matter presented herein. But various alternatives may be used without departing from the scope of claims and the subject matter may be practiced without these specific details. For example, the subject matter presented herein can be implemented on many types of electronic devices with digital video capabilities.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

In the present disclosure, it should be understood that terms such as "up," "down," "left," "right," "top," "bottom," "front," "rear," etc., indicating directions or positional relationships, are based on the orientations or positional relationships shown in the accompanying drawings. These terms are used for case of description and simplification, and do not imply that the indicated devices or components must have specific orientations or be constructed and operated in specific orientations. Therefore, they should not be construed as limitations to the present disclosure. Additionally, the terms "front-rear direction," "front-rear direction of the seating unit or device," "front and rear direction" refer to the direction of the backrest and ottoman relative to the seating part. Specifically, "rear" indicates the direction toward the backrest, while "front" indicates the direction toward the ottoman.

It should be illustrated that the terms "first," "second," and the like used in the description, claims of the present disclosure, and the accompanying drawings are used to distinguish objects, and not used to describe any specific order or sequence. It should be understood that the data used in this way may be interchanged under an appropriate condition, such that the embodiments of the present disclosure described herein may be implemented in orders besides those shown in the accompanying drawings or described in the present disclosure.

The technical problem to be solved by the present disclosure is to provide a mechanical extension device for a movable seat or seating device with a simple structure and enhanced comfort and a corresponding movable seating device. The seating device should not only meet the spatial requirements of zero wall clearance arrangements for movable seats but also, during the posture or position transition of the movable seat, it should prevent gaps between the rear edge of the seat and the lower edge of the backrest, achieving a zero-gap design. Moreover, it avoids pulling out the user's upper clothing due to improper relative movement between the backrest and the seat during the seat's unfolding, thus providing a zero-back-rubbing comfort experience.

FIG. 1 to FIG. 4 show in perspective views a mechanical extension device 1 for a movable seating device according to the present disclosure. The mechanical extension device 1 includes a multi-link mechanism and is configured to enable the movable seating device is configured to transform or switch between a sitting position, a TV position and a reclining position. However, the present disclosure is not limited to this, in other embodiments not shown, the movable seat can also transform or switch only between the folded position and the TV position or only between the folded position and the reclining position.

As shown in FIG. 1 to FIG. 4, the mechanical extension device is configured for an armrest floor-standing movable seat and includes mechanical extension device halves arranged mirror symmetrically on the left and right sides. Each mechanical extension device half has a fixed plate 12 extending longitudinally in the front-to-back direction of the movable seat. Each mechanical extension device half is arranged by means of its respective fixed plate 12 on an inner panel of the armrest that is not shown in FIG. 1. Each fixed plate 12 is respectively attached by means of a fixed tab 51 to a common fixed beam 52 which is located on the backrest side, i.e. at the rear of the movable seat. The bottom of the armrest is supported directly on the ground, so that the mechanical extension device is "suspendedly" supported above the ground.

The mechanical extension device 1 further includes a seat frame 10, a backrest assembly 2 pivotably connected to the rear part of the seat frame 10, and a leg extension device 3 pivotably connected to the front part of the seat frame 10.

The seat frame 10 is utilized to carry the seat of the movable seating device, and the seat frame 10 includes a seat frame rear extension 11 that is fixedly placed at the rear part of the seat frame 10 and extending upwardly. The seat frame rear extension 11 may be integrated with the seat frame 10, and may also be fixedly connected to the seat frame 10 as a separate component. For example, the seat frame rear extension 11 may be fixedly installed on the seat frame 10 using welding, riveting, etc.

The backrest assembly 2 includes a backrest bracket 21 for attaching the backrest of the movable seating device, a first backrest link 22, and a second backrest link 23. The backrest bracket 21 has a generally L-shaped structure. The front end of the backrest bracket 21 is pivotally connected to the upper end of the first backrest link 22 at a first pivot point P1. The lower end of the first backrest link 22 is pivotally connected to the rear end of the seat frame 10 at a second pivot point P2. The second backrest link 23 may be configured as a bent piece, e.g., bell crank, and has three pivot points respectively at the middle of the bent piece and at ends of the two arms. In some examples, the second backrest link 23 is pivotally connected with the rear end of the backrest bracket 21 by its upper end at the third pivot point P3, and the second backrest link 23 is pivotally connected at its middle to the upper end of the seat frame rear extension 11 of the seat frame at the fourth pivot point P4. The fourth pivot point P4 is located further back compared to the second pivot point P2. Therefore, a four-bar linkage is formed by the backrest bracket 21, the seat frame 10, and the first backrest link 22 and the second backrest link 23 that connect the backrest bracket 21 and the seat frame 10. In addition, the lower end of the second backrest link 23 and the upper end of a fixed plate link 24 are pivotably connected at the fifth pivot point P5, and the lower end of the fixed plate link 24 is pivotably connected to rear part of the fixed plate 12.

Figure 7:
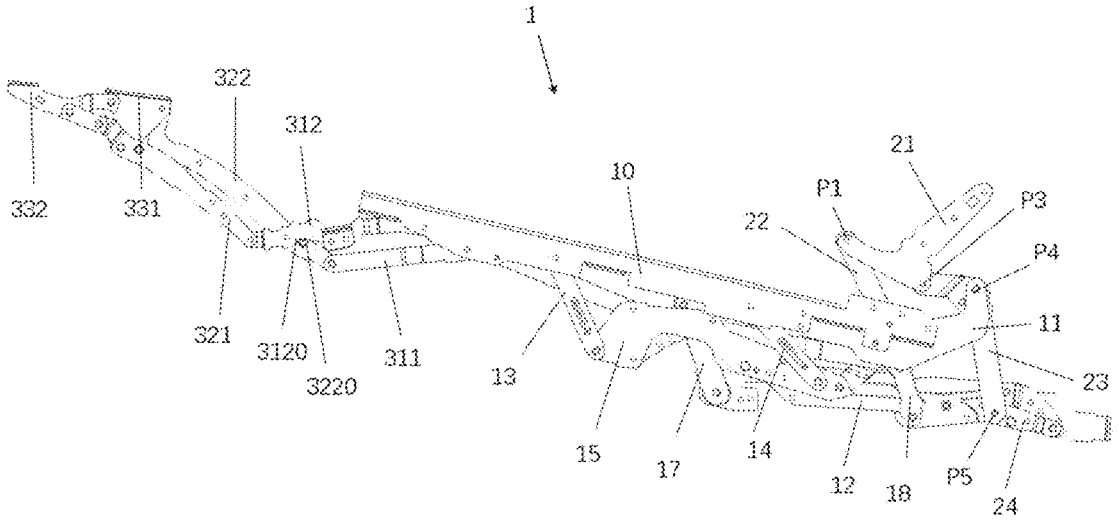
FIG. 7 illustrates a side view of a mechanical extension device as shown in FIG. 5 in a reclining position.
Figure 8:
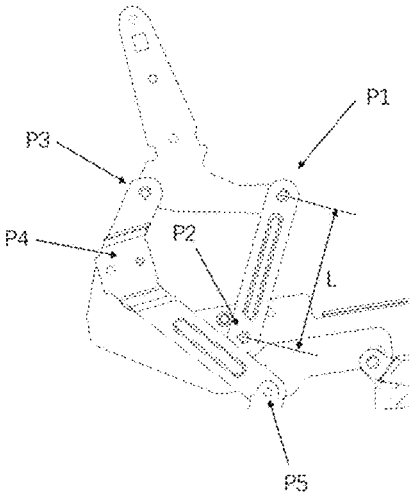
FIG. 8 illustrates a partial side view of a mechanical extension device according to some examples of the present disclosure.

FIG. 8 shows details of the backrest components in a side view. The distance L between the first pivot point P1 and the second pivot point P2 of the first backrest link 22 is in the range of 80 mm to 150 mm, and may be within 100 mm to 140 mm in some examples. In the examples shown in FIG. 1 to FIG. 8, the distance L between the first pivot point P1 and the second pivot point P2 is within 115 mm to 120 mm. The first backrest link 22 forms a first angle $\alpha$ with the seat frame 10 that opens toward the leg extension device 3, and the first angle $\alpha$ is an acute angle. In addition, the distance between the third pivot point P3 and the fourth pivot point P4 of the second backrest link 23 may be within 45 mm to 90 mm, and may be within 60 mm to 80 mm in some examples. The distance between the fourth pivot point P4 and the fifth pivot point P5 may be within 85 mm to 200 mm, and may be within 120 mm to 160 mm in some examples.

As mentioned above, the fixed plate 12 of the mechanical extension device 1 is fixedly installed on the armrest part (not shown in the Figures). The seat frame 10 is movably connected to the fixed plate 12 by means of linkages. The linkages may include a main linkage and an auxiliary linkage, and the main linkage at least includes a front swing link 13, a rear swing link 14, and an intermediate link 15. The auxiliary linkage at least includes an auxiliary front swing link 17, an auxiliary rear swing link 18, and an auxiliary intermediate link 19*a*. The main linkage is configured to move the seat frame 10 forward and backward relative to the intermediate link 15 during the transition process of the seating device between the sitting position and the TV position. At the same time, the intermediate link 15 remains substantially un-moved in position relative to the armrest. The auxiliary linkage is configured to move the seat frame together with the main linkage forward and backward relative to the armrest during the transition process of the seating device between the TV position and the reclining position. In some examples, the main linkage is configured to drive the seat frame 10 to move forward and downward relative to the intermediate link 15 during the transition process of the seat unit from the sitting position to the TV position. At the same time, the intermediate link 15 has essentially no relative movement with respect to the armrest, and consequently, relative to the fixed plate 12. The auxiliary link is configured to drive the seat frame 10 together with the main link to move forward and upward relative to the armrest during the transition process of the seating device from the TV position to the reclining position.

The upper ends of the front swing link 13 and the rear swing link 14 are pivotally connected to the seat frame 10 respectively, and the intermediate link 15 is pivotally connected between the front swing link 13 and the rear swing link 14. In addition, a seat frame linkage 16 is pivotally connected between the front end of the intermediate link 15 and the seat frame 10. Thus, a four-bar linkage is formed through the seat frame 10, the front swing link 13, the rear swing link 14 and the intermediate link 15. When the leg extension device 3 starts to extend from the sitting position under the action of the linear electric drive device, the leg extension device 3 drives the seat frame 10 to move forward, causing the front swing link 13 and the rear swing link 14 to tilt forward surrounding their pivot points on the intermediate link 15.

The auxiliary front swing link 17 and the auxiliary rear swing link 18 are respectively pivotally connected to the fixed plate 12. The upper end of the auxiliary front linkage 17*a* is pivotally connected to the upper end of the auxiliary front swing link 17, and the lower end of the auxiliary front linkage 17*a* is pivotally connected to the front part of the intermediate link 15; the upper end of the auxiliary rear linkage 18*a* is pivotally connected to the upper end of the auxiliary rear swing link 18, the lower end of the auxiliary rear linkage 18*a* is pivotally connected with the rear part of the intermediate link 15.

The rear end of the auxiliary intermediate link 19*a* is pivotally connected to the middle part of the auxiliary rear linkage 18*a*, and the front end of the auxiliary intermediate link 19*a* is pivotally connected to the top end of the auxiliary front swing link 17. In addition, a follower link 19*b* is pivotally connected between the middle part of the auxiliary intermediate link 19*a* and the top end of the auxiliary rear swing link 18.

Therefore, the intermediate link 15 is suspended and supported on the fixed plate 12 in a manner that allows it to move back and forth, through the use of the auxiliary front swing link 17, the auxiliary front linkage 17*a*, the auxiliary rear swing link 18, and the auxiliary rear linkage 18*a*.

Figure 3:
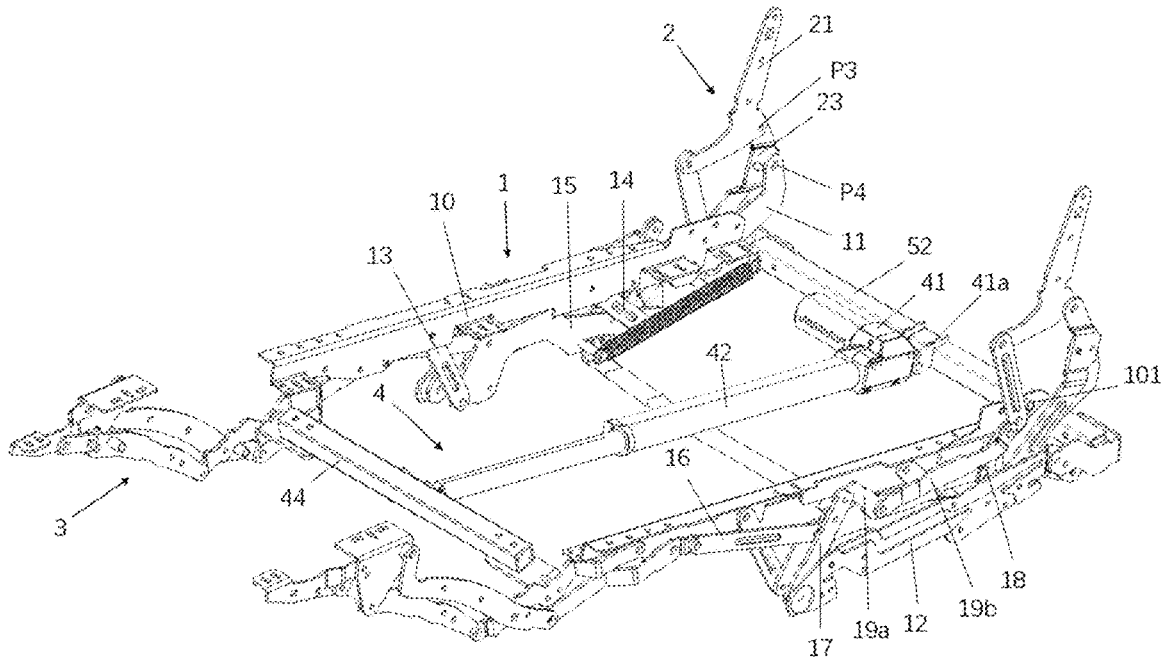
FIG. 3 illustrates another perspective view of the mechanical extension device shown in FIG. 2 in a TV position.

When the seat frame linkage 16 is driven to move forward to the extreme position, that is, when it reaches the TV position shown in FIG. 3, if the linear electric drive device continues to act in the same direction, the intermediate link 15 together with the seat frame 10 moves forward, thereby driving the auxiliary front swing link 17 and the auxiliary rear swing link 18 to pivotally forward and tilt around the pivot points of their lower ends and the fixed plate 12 respectively.

The leg extension device 3 includes a first extension 31, a second extension 32 and a footrest 33 for attaching an ottoman. The first extension 31 includes a first connecting link 311 and a second connecting link 312. A limit slot 3120 is placed on the second connecting link 312. The second extension 32 includes a third connecting link 321 and a fourth connecting link 322. The fourth connecting link 322 includes a limit nail 3220. The first connecting link 311 is rotatably connected to the fourth connecting link 322, and the second connecting link 312 is rotatably connected to the third connecting link 321. The footrest 33 includes a connecting end surface 331 and an end surface 332. In some examples, the first connecting link 311 and the second connecting link 312 are both rotatably installed on the seat frame 10. Further, the pivot point of the first connecting link 311 with the seat frame 10 is located behind the pivot point of the second connecting link 312 with the seat frame 10.

The footrest 33 is rotatably connected to the third connecting link 321 and the fourth connecting link 322. When the leg extension device 3 is extended, that is, in the TV position shown in FIG. 2 and the reclining position shown in FIG. 3, the second connecting link 312 protrudes further forward than the first connecting link 311.

Figure 2:
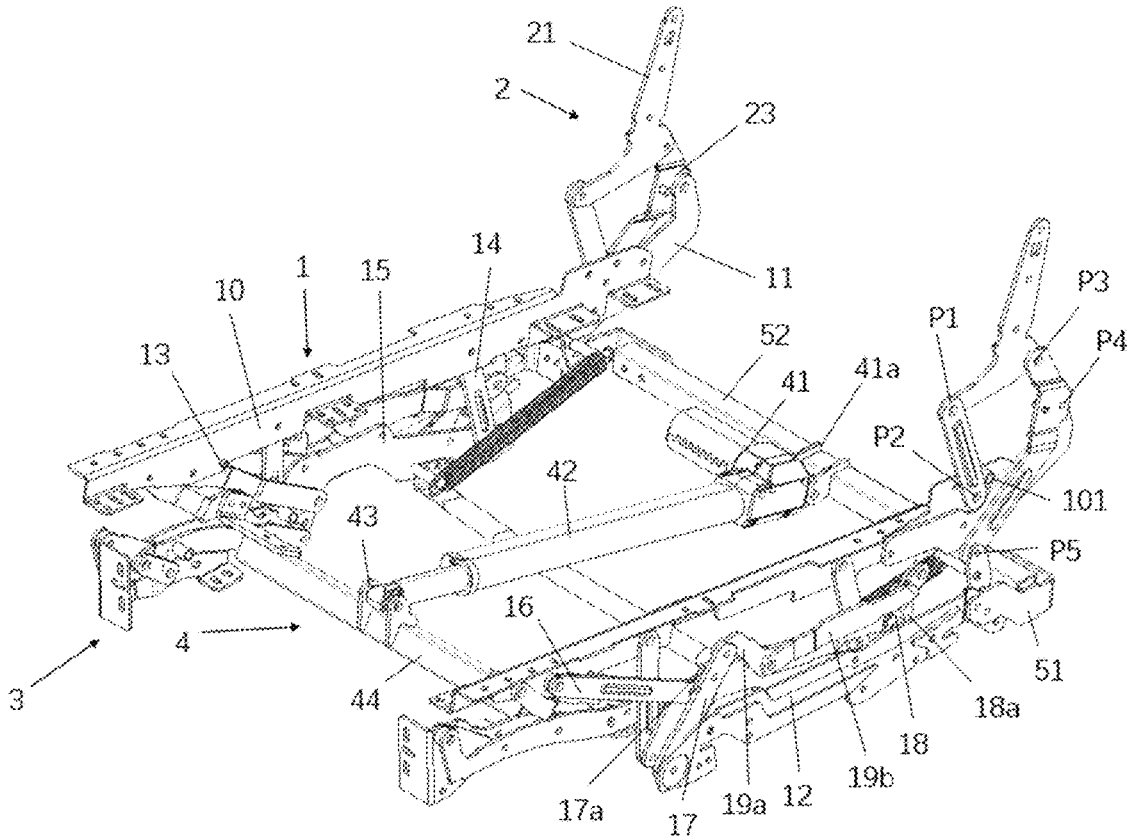
FIG. 2 illustrates another perspective view of a mechanical extension device shown in FIG. 1.

As shown in FIGS. 2 and 3, a rest spring device may also be placed between the linkage assembly and the inner plate to assist in resetting the position transition.

In some examples, the mechanical extension device 1 may also include a linear electric actuator 4, which includes a motor head 41 and a motor push rod 42 that is extendable relative to the motor head 41. The motor head 41 is installed in a fixed position relative to the armrest. For example, in the examples shown in FIGS. 1 to 4, the motor head 41 is pivotably connected to a motor head bracket 41*a*, and the motor head bracket 41*a* is fixedly installed on the fixed beam 52. Here, during the transition of the seating device from the sitting position to the reclining position, the motor head bracket 41*a* does not have any forward or backward directional movement components, but can pivot around an axis that is transverse to the forward and backward direction. The motor push rod 42 acts on a front drive tube 44, which is transversely connected between the second connecting link 312 of the leg extension device 3. In some examples, the positions of the motor head 41 and the motor push rod 42 may also be reversed. As shown in FIG. 1, the motor push rod 42 is attached to the front drive tube 44 with the help of the motor bracket 43, where the motor push rod 42 is pivotally connected to the motor bracket 43, and the motor bracket 43 is fixedly connected to the front drive tube 44.

Figure 5:
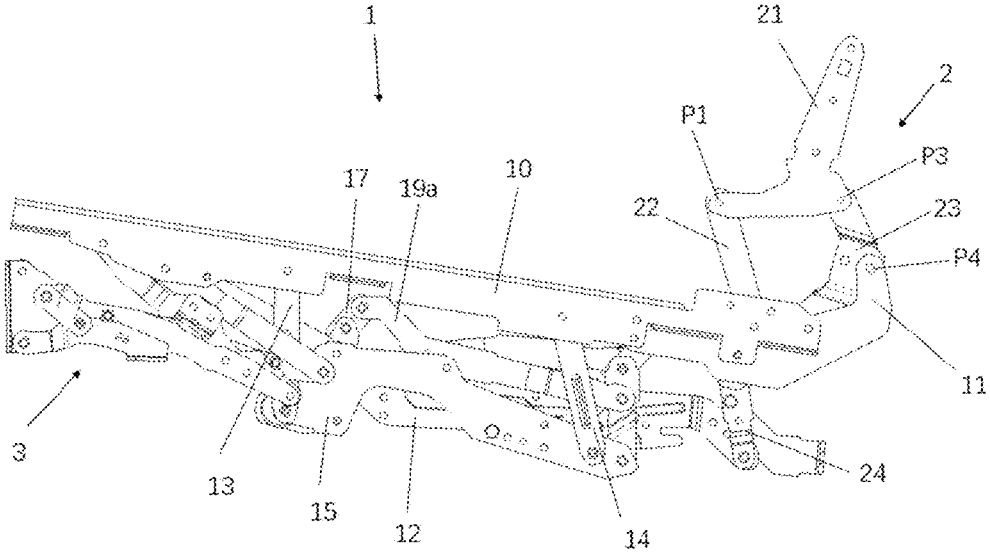
FIG. 5 illustrates a side view of a mechanical extension device in a sitting position according to some examples of the present disclosure.
Figure 6:
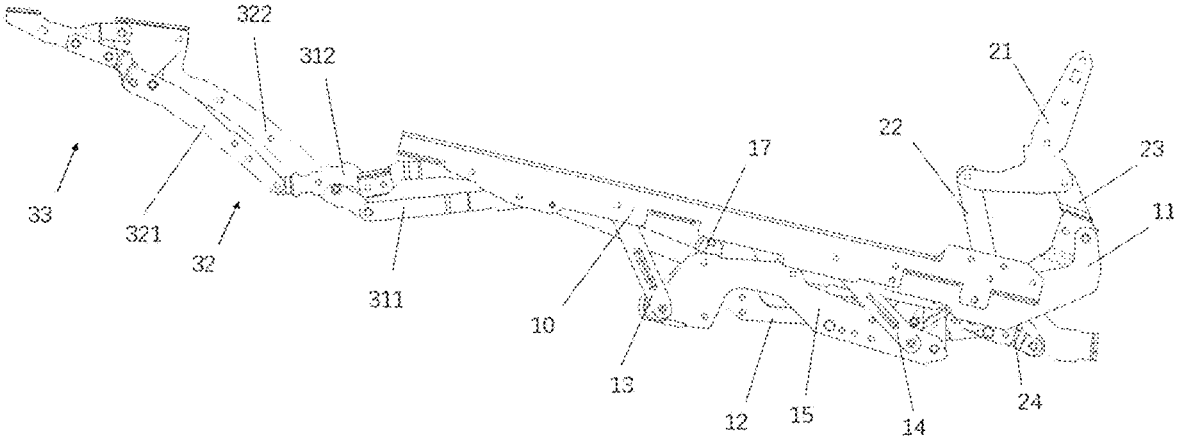
FIG. 6 illustrates a side view of the mechanical extension device as shown in FIG. 5 in a TV position.

If the seating device needs to transition from the sitting position shown in FIGS. 2 and 5 to the TV position shown in FIGS. 3 and 6, the mechanical extension device 1 starts to extend under the action of the linear electric actuator 4. The motor push rod 42 extends relative to the motor head 41, pushing the second linkage rod 312 of the leg mechanical extension device 3 forward, which in turn drives the seat frame 10 forward. The front swing link 13 and rear swing link 14 tilt forward, thereby achieving the TV position shown in FIGS. 3 and 6. During this process, as the seat frame 10 moves forward in the horizontal direction towards the leg mechanical extension device 3, it causes the first backrest link 22 to pivot slightly forward around its lower pivot point P2, showing a tendency to rotate counterclockwise in the diagram. For this purpose, a first stopper 101 is placed on the seat frame 10 behind the first backrest link 22 to support the rear of the first backrest link 22, preventing it from swaying in the sitting position and thus maintaining stable support of the backrest bracket 21. In this case, the backrest bracket 21, first and second backrest links 22 and 23, along with the seat frame 10 and its seat frame rear extension 11, move forward in the horizontal direction, driving the fixed plate link 24 to rotate forward around its lower pivot point with the fixed plate 12. At the same time, as the front swing link 13 and the rear swing link 14 tilt forward, the seat frame 10, especially its rear end, descends in the vertical direction.

Furthermore, in the process of transitioning from the sitting position to the TV position, as the seat frame 10 drives the entire backrest bracket 21 to move forward, the rearmost endpoint of the backrest bracket 21 has a forward-moving component. Simultaneously, the first pivot point P1 of the backrest bracket 21 with the first backrest link 22 has a forward-moving trajectory in the horizontal direction. Additionally, as the rear end of the seat frame 10 descends vertically, this first pivot point P1 also follows a downward trajectory in the vertical direction.

Figure 4:
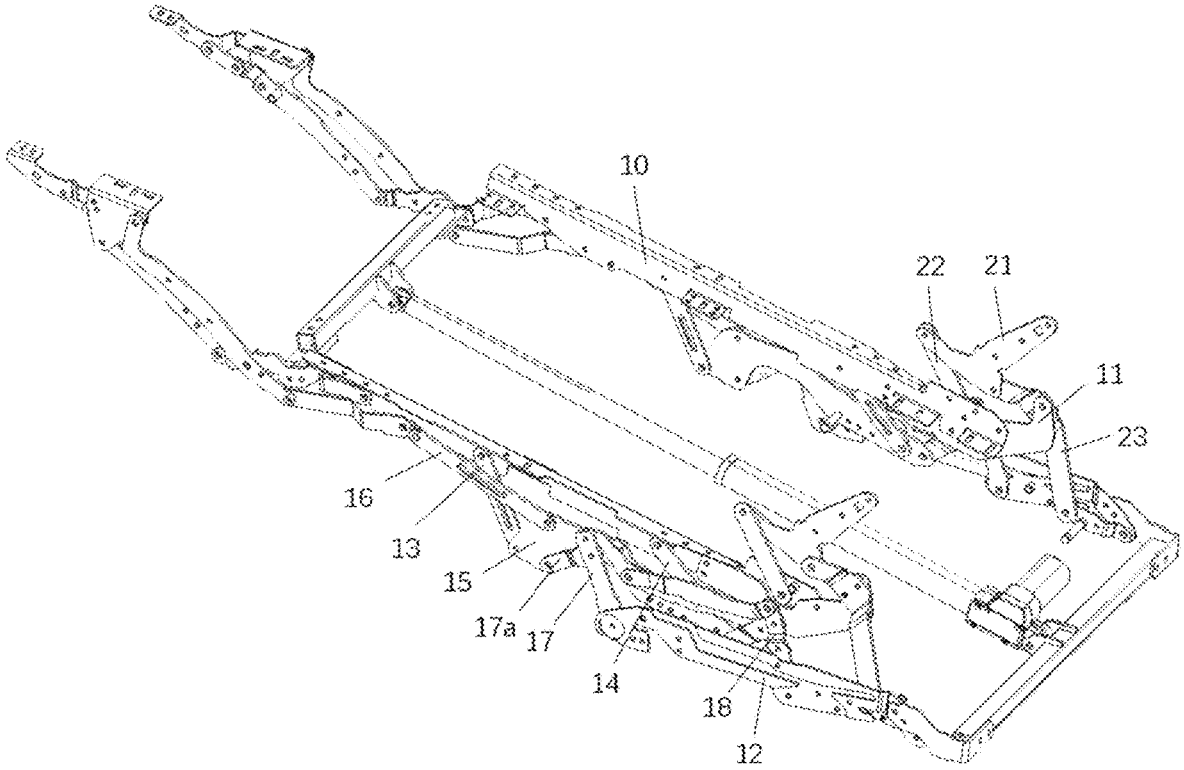
FIG. 4 illustrates another perspective view of the mechanical extension device shown in FIG. 2 in a reclining position.

If the seating device needs to transition from the TV position shown in FIGS. 3 and 6 to the reclining position shown in FIGS. 4 and 7, the motor push rod 42 continues to extend further relative to the motor head 41. The seat frame 10 is driven forward by the leg mechanical extension device 3, and the front and rear swing links 13 and 14 tilt forward to their limit positions. The intermediate link 15, along with the seat frame 10, moves forward and simultaneously lifts upwards, thereby driving the auxiliary front swing link 17 and auxiliary rear swing link 18 to pivot forward around their lower pivot points with the fixed plate 12. Furthermore, the second backrest link 23 rotates counterclockwise around its lower pivot point P5, which is hinged to the fixed plate linkage 24, tilting towards the direction of the leg mechanical extension device, thereby reducing the height difference between its upper end and the fourth pivot point P4 in the middle, and thus pushing the backrest bracket 21 forward as a whole. The upper part of the backrest bracket 21 tilts further backward, and the angle of the first backrest link 22 relative to the seat frame 10 decreases. This achieves the reclining position as shown in FIGS. 4 and 7. During this process, although the backrest bracket 21 pivots backwards clockwise around the third pivot point P3, on the one hand, due to the forward movement of the seat frame 10 itself, and on the other hand, the backrest bracket 21 also moves forward relative to the seat frame 10 through the linked action of the first and second backrest links 22 and 23. Therefore, the first pivot point P1 and the rearmost endpoint of the backrest bracket 21 both follow a forward-moving trajectory.

Figure 9:
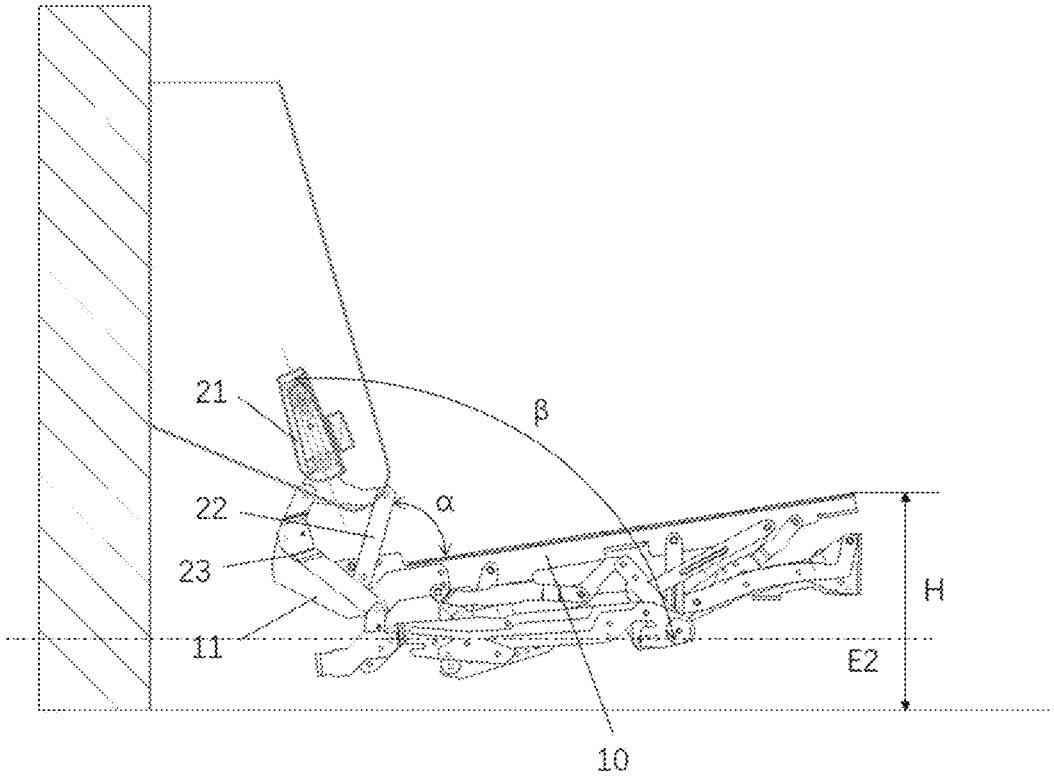
FIG. 9 schematically shows a sitting position of a mechanical extension device of a backrest of a movable seating device.
Figure 10:
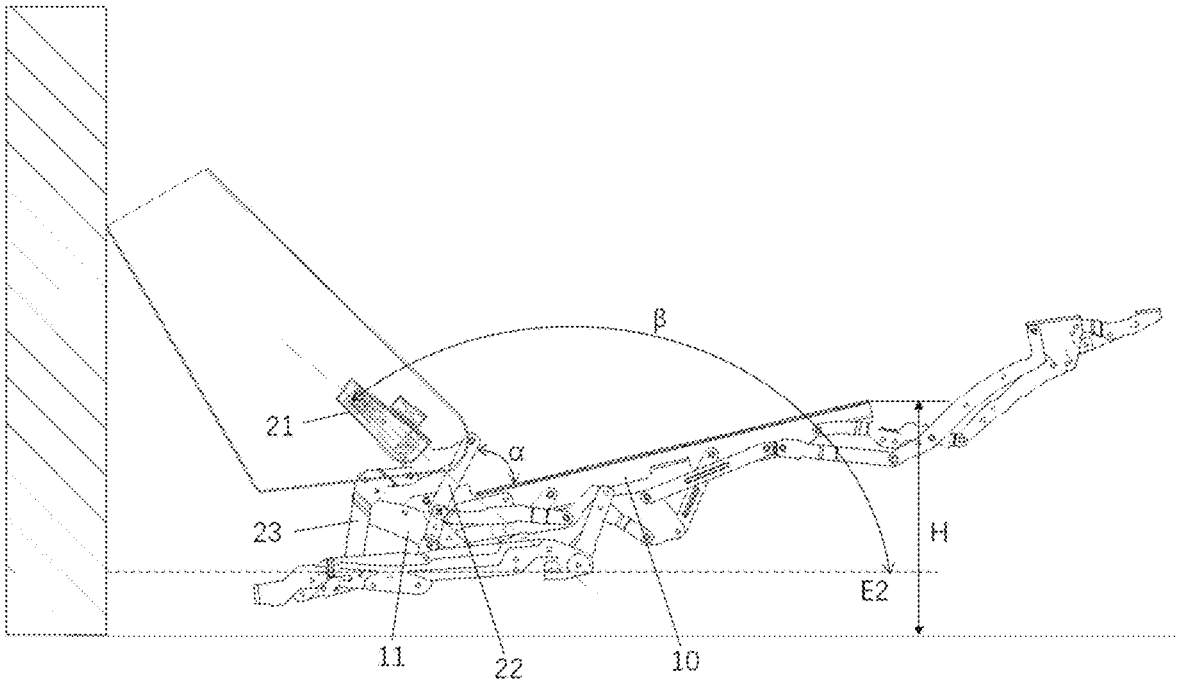
FIG. 10 schematically shows a reclining position of a mechanical extension device of a backrest of a movable seating device.

FIGS. 9 and 10 schematically show the examples of the seating device in the sitting and reclining positions, respectively. For clarity, only the mechanical extension device and the backrest of the seating device or the seat unit are shown, along with a schematic representation of the wall behind the seating device and the horizontally oriented ground.

In the transition from the sitting position shown in FIG. 9 to the reclining position shown in FIG. 10, viewed from the front and back direction of the seating device, the rear end of the backrest bracket 21 moves significantly forward, while the rear end of the backrest does not move backward but remains flush with the wall behind it, resulting in the backrest only lowering vertically during this process. Furthermore, in other feasible scenarios not shown, the rear end of the backrest may also move forward during the transition from the sitting position to the reclining position.

Figure 11:
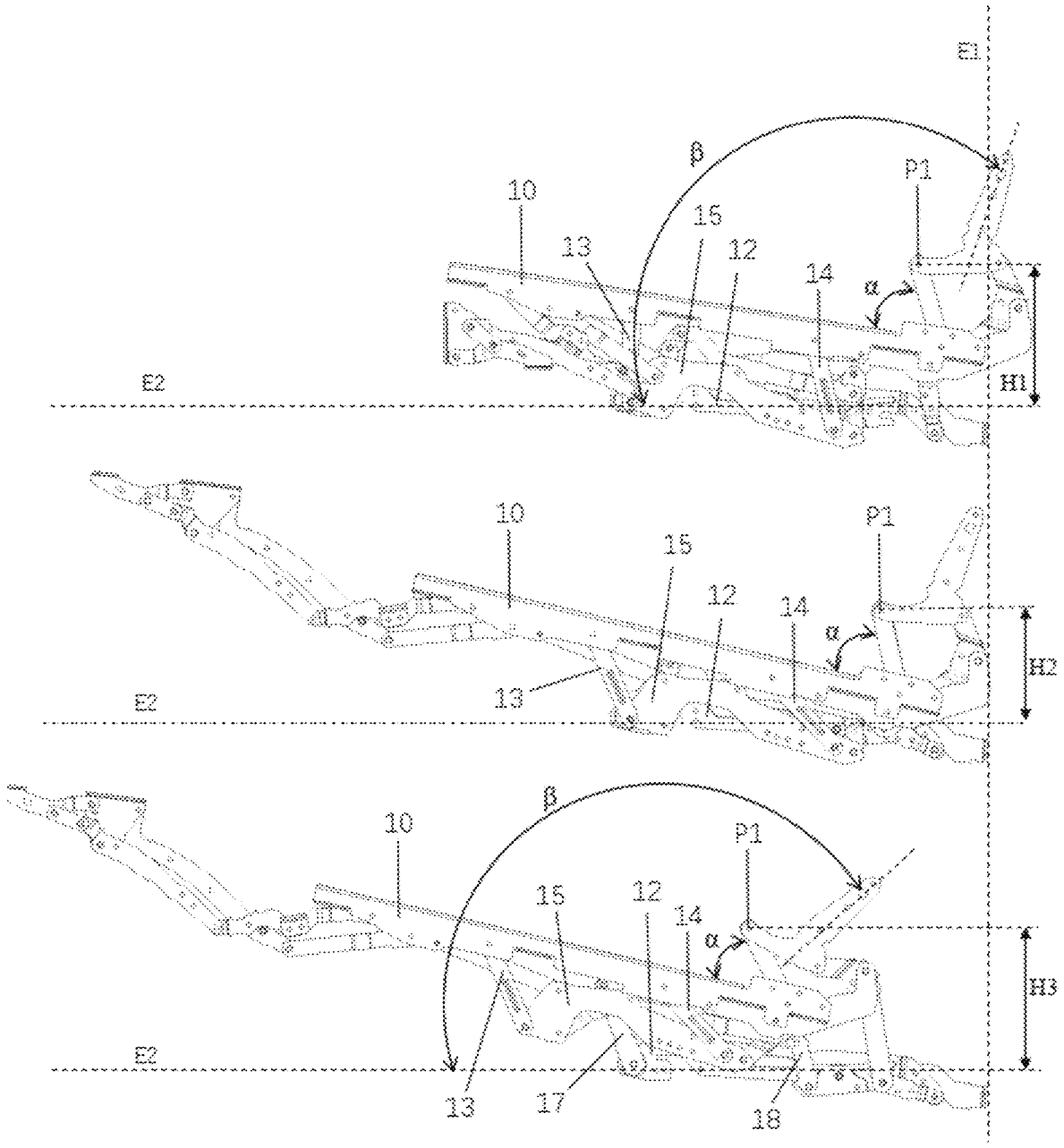
FIG. 11 shows a schematic diagram of position transition of the mechanical extension device according to the present disclosure.

FIG. 11 schematically shows the position transitions between the sitting position, the TV position, and the reclining position of the mechanical extension device according to the present disclosure. The fixed plate 12 is securely and fixedly mounted relative to the armrest of the seating device. For clearer illustration, the vertical plane where the rear end of the fixed plate 12 is located is defined as the first reference plane E1, and the horizontal plane at the lower area of the fixed plate 12 is defined as the second reference plane E2. During the position transitions, both the first reference plane E1 and the second reference plane E2 remain fixed in position relative to the floor-standing armrest of the seating device. In FIG. 11, the upper part shows the sitting position of the mechanical extension device, the middle part shows the TV position, and the lower part shows the reclining position.

The front side of the first backrest link 22 forms a first angle $\alpha$, which opens forward, i.e., towards the direction of the leg extension device, with the top surface of the seat frame 10. The backrest bracket 21 forms a second angle $\beta$ with the second reference plane E2. The vertical height of the first pivot point P1 of the backrest bracket 21 relative to the first reference plane E1 in the sitting, the TV, and the reclining positions is respectively H1, H2, and H3.

During the transition from the sitting position to the reclining position, the first angle α significantly decreases, while the second angle β significantly increases, with the second angle β increasing by at least 20 degrees.

In one or more examples, during the transition from the sitting position to the reclining position, the first angle α remains less than 90 degrees throughout, and it significantly decreases in the reclining position compared to the sitting position, while the second angle β significantly increases.

The footrest is raised by 300 mm to 400 mm in the reclining position compared to the sitting position, preferably raised by 320 mm to 380 mm. This significantly enhances the user's comfort.

During the transition from the sitting position to the TV position, as the front swing link 13 and the rear swing link 14 pivot forward, and since the intermediate link 15 does not move relative to the fixed plate 12, the seat frame 10 moves forward, causing its rear end to drop. Simultaneously, the first pivot point P1 moves forward in the horizontal direction, and as the rear end of the seat frame 10 descends, the height H2 of the first pivot point P1 in the TV position is less than its height H1 in the sitting position.

During the transition from the TV position to the reclining position, the intermediate link 15, along with the seat frame 10, moves forward and upward relative to the fixed plate 12, and this motion is used to drive the backrest bracket 21 forward and upward via the first backrest link 22. Consequently, the first pivot point P1 also moves forward and upward, resulting in a height H3 in the reclining position that is greater than its height H2 in the TV position. By selecting an appropriate length for the first backrest link 22, it ensures that the height H3 of the first pivot point P1 in the reclining position exceeds its height H1 in the sitting position. During this process, since the first angle α is less than 90°, it facilitates the forward flipping and tilting of the first backrest link 22 around the second pivot point P2 in a counterclockwise direction, without interfering with or hindering the lifting of the seat frame 10.

According to one aspect, the present disclosure provides a mechanical extension device which includes a seat frame for attaching a seat; a backrest assembly pivotally connected to the rear of the seat frame, including a backrest bracket for attaching the backrest; and a leg extension device pivotally connected to a front part of the seat frame, where the leg extension device is configured to attach an ottoman of the seating device.

Additionally, the mechanical extension device is configured to move the seating device from a first position to a second position, where the seating device is capable of being in multiple positions comprising a sitting position, a reclining position, and a TV position; in the sitting position, the ottoman is located under the seat; in the reclining position, the ottoman extends forward and upward, and the backrest tilts backward; in the TV position, the leg mechanical extension device extends forward and upward, but the backrest bracket does not undergo significant tilting; in the process of moving the seating device from the sitting position to the reclining position, a rear end of the backrest bracket has no component that moves backward.

In some examples, the backrest assembly may include a backrest bracket, a first backrest link, and a second backrest link, the backrest bracket is configured to attach the backrest, the first backrest link is pivotally connected to a front end of the backrest bracket at a first pivot point, the first backrest link is pivotally connected to the seat frame at a second pivot point, and the first pivot point has a trajectory that moves towards the leg extension device in the process of moving the seating device from the sitting position to the reclining position.

In some examples, the backrest assembly may include a backrest bracket, a first backrest link, and a second backrest link. The second backrest link is a bent piece, where the bent piece may include a third pivot point, a fourth pivot point, and a fifth pivot point, the third pivot point is located on a free end of an upper arm of the bent piece, the fifth pivot point is located on a free end of a lower arm of the bent piece, the fourth pivot point is located between the third and fifth pivot points, the second backrest link is pivotally connected with the rear end of the backrest bracket at the third pivot point, and the second backrest link is pivotally connected with the seat frame at the fourth pivot point, and the fourth pivot point is located further back compared to the second pivot point.

In the present disclosure, "forward and backward directions" refers to the direction of extension of the leg extension device in the seating device or the mechanical extension device. Specifically, "forward" refers to the direction towards the leg mechanical extension device, and 'backward' refers to the direction towards the backrest.

In some examples, the first backrest linkage forms a first angle with the seat frame, which opens towards the direction of the leg extension device. This first angle decreases in the reclining position compared to the sitting position.

In some examples, the backrest bracket forms a second angle with the horizontal plane, which opens towards the direction of the leg extension device. This second angle increases by at least 20 degrees in the reclining position compared to the sitting position, and in one or more examples, by at least 30 degrees.

In some examples, the leg mechanical extension device includes a footrest for attaching the an ottoman. In the reclining position compared to the sitting position, the footrest is raised by 300 mm to 400 mm, and in one or more examples, by 320 mm to 380 mm. This significantly enhances the user's comfort.

According to the present disclosure, the first backrest link is pivotally connected at both its upper and lower ends to the backrest bracket and the seat frame, respectively. This additional degree of freedom allows the backrest bracket to move forward relative to the seat frame, thereby optimizing the wall distance of the mechanical extension device and even the movable seating device that incorporates this type of mechanical extension device, achieving a more thorough zero wall clearance. Additionally, the rear end of the backrest link is coupled to the seat frame solely through one component, namely the second backrest link, which simplifies the mechanical structure while optimizing motion characteristics.

In some examples, the seat frame may include a stopper located behind the first backrest link, where the stopper is capable of supporting the first backrest link to prevent it from swaying in the sitting position. In these examples, the stopper positioned on the seat frame effectively restricts, or even prevents, the back ward rotation of the first backrest link, thereby greatly limiting or eliminating the backward displacement component of the backrest bracket during the transition from the sitting position to the TV position and reclining position. This avoids unfavorable interference with the wall behind the seating device.

In some examples, the mechanical extension device includes a fixed plate that is securely or fixedly connected to the armrest of the movable seating device. The rear part of the fixed plate is pivotally connected to one end of a fixed plate link, and the second backrest link is also pivotally connected at the other end of the fixed plate link at the fifth pivot point.

In some examples, the seat frame is attached to the fixed plate in a manner that allows it to move back and forth through a linkage mechanism.

In some examples, the linkage mechanism may include a main linkage and an auxiliary linkage. The main linkage includes an intermediate link that is pivotally connected to the auxiliary linkage. During the transition of the mechanical extension device from the sitting position to the reclining position, relative displacements occur sequentially between the seat frame and the intermediate link, and between the intermediate link and the fixed plate.

In some examples, the linkage mechanism may include a seat frame linkage. The rear end of the seat frame linkage is connected to the intermediate link, and the front end of the seat frame linkage is connected to the leg extension device.

According to another aspect, the present disclosure provides a mechanical extension device for a movable seating device, including: a seat frame for attaching the seat; a backrest bracket coupled to the rear part of the seat frame; a leg extension device coupled to the front part of the seat frame. The mechanical extension device can transition between sitting, TV, and reclining positions. In the sitting position, the leg extension device is retracted under the seat frame; in the TV position, the leg extension device is lifted forward and upward; in the reclining position, the leg extension device is lifted forward and upward, and the backrest bracket tilts backward. During the transition from the sitting position to the TV position and then to the reclining position, the rear end of the backrest bracket exhibits a forward movement trend.

In one example, the backrest bracket is coupled to the seat frame via the first and second backrest links. The upper end of the first backrest link is pivotally connected to the front end of the backrest bracket at the first pivot point, and the lower end of the first backrest link is pivotally connected to the rear part of the seat frame at the second pivot point. During the transition of the mechanical extension device from the sitting position to the reclining position, the first pivot point has a motion trajectory that moves towards the direction of the leg extension in the horizontal direction, and it has a motion trajectory in the vertical direction that first moves downward and then upward.

In this example, during the transition from the sitting position to the reclining position, the first pivot point, driven by the seat frame, causes the backrest bracket, along with the attached backrest, to move towards the direction of the leg mechanical extension device, i.e., forward. Additionally, since the first pivot point initially moves downward and forward in the vertical direction, this avoids inappropriate separation between the backrest and the seat. On one hand, this ensures that there are no gaps between the backrest and the seat, preventing foreign objects from getting trapped and enhancing safety; on the other hand, it prevents the user's upper clothing from being pulled up by the backrest, thus improving comfort.

In another example, the backrest bracket is coupled to the seat frame via the first and second backrest links, where the upper end of the first backrest link is pivotally connected to the front end of the backrest bracket at the first pivot point, and the lower end of the first backrest link is pivotally connected to the rear part of the seat frame at the second pivot point. The distance between the first pivot point and the second pivot point ranges from 80 mm to 150 mm, and the first angle formed by the first backrest linkage with the seat frame, opening towards the direction of the leg mechanical extension device, is less than 90 degrees.

In some examples, the distance between the first pivot point and the second pivot point ranges from 100 mm to 140 mm, and in one or more examples, the distance is between 115 mm and 120 mm.

In these examples, the first backrest link is optimized in terms of structural design and connection relationships. Since the angle formed by the first backrest link with the seat frame toward the direction of the leg extension device is always less than 90 degrees, that is, always acute, with the first backrest link at a suitable size, it ensures that during the transition from the sitting position to the reclining position, the first backrest link connected between the front end of the backrest bracket and the seat frame is further pressed downward as the backrest bracket moves forward. This means that the upper end of the first backrest linkage further flips forward around the second pivot point, further facilitating the forward movement of the backrest bracket, thereby achieving a complete zero wall clearance during the transition from sitting to reclining positions. On the other hand, this also avoids stalling during posture transitions, making operation smoother and enhancing functional reliability.

In some examples, the first pivot point is higher in the reclining position than in the sitting position.

In some examples, during the transition from the sitting position to the TV position, the first pivot point moves forward and downward, and during the transition from the TV position to the reclining position, the first pivot point moves forward and upward.

In some examples, the second backrest linkage is pivotally connected at the third pivot point to the rear end of the backrest bracket and at the fourth pivot point to the rear part of the seat frame, where the fourth pivot point is further back compared to the second pivot point.

In some examples, during the transition from the sitting position to the TV position, the rear end of the seat frame lowers relative to the fixed plate; during the transition from the TV position to the reclining position, the seat frame is raised relative to the fixed plate.

In some examples, the second backrest link is designed as a bent piece, e.g., a bell crank, and also includes a fifth pivot point, where the third and fifth pivot points are located at the free ends of the upper and lower arms of the bent piece, respectively, and the fourth pivot point is located between the third and fifth pivot points, with the second backrest link being coupled directly or indirectly at the fifth pivot point to the fixed plate.

According to the present disclosure, the seat frame is attached to the fixed plate in a manner that allows it to move back and forth through the main linkage and the auxiliary linkage, with the seat frame being pivotally connected to the main linkage, and the auxiliary linkage being pivotally connected to the fixed plate.

In some examples, the main linkage includes an intermediate link that is pivotally connected to the auxiliary linkage. During the transition of the mechanical extension device from the sitting position to the TV position, the main linkage drives the rear end of the seat frame to move downward and forward relative to the intermediate link, where the intermediate link has no relative displacement with respect to the fixed plate. During the transition from the TV position to the reclining position, the auxiliary linkage drives the seat frame, along with the main linkage, to move forward and upward relative to the fixed plate.

In some examples, the mechanical extension device is used for armrest floor-standing movable seats. Alternatively, the mechanical extension device can also be reasonably applied to other types of movable seats.

In some examples, the mechanical extension device includes a linear electric actuator. In other examples, the mechanical extension device may be manual or a combination of manual and motor-driven methods.

According to another aspect, the present disclosure provides a seating device including an armrest; a seat; a backrest; an ottoman; and a mechanical extension device including: a seat frame attached to the seat; a backrest assembly pivotally connected to a rear part of the seat frame, where the backrest assembly includes a backrest bracket configured to attach a backrest of the seating device; a leg extension device pivotally connected to a front part of the seat frame, where the leg extension device is configured to attach the ottoman.

Furthermore, the mechanical extension device is configured to move the seating device from a first position to a second position, where the seating device is capable of being in multiple positions comprising a sitting position and a reclining position; where in the sitting position, the ottoman is located under the seat; where in the reclining position, the ottoman extends forward and upward, and the backrest tilts backward; where in the process of moving the seating device from the sitting position to the reclining position, a rear end of the backrest bracket has no component that moves backward.

Moreover, the backrest assembly includes a backrest bracket, a first backrest link, and a second backrest link, the backrest bracket is configured to attach the backrest, the first backrest link is pivotally connected to a front end of the backrest bracket at a first pivot point, the first backrest link is pivotally connected to the seat frame at a second pivot point, and the first pivot point has a trajectory that moves towards the leg extension device in the process of moving the seating device from the sitting position to the reclining position.

In some examples, the mechanical extension device in the seating device includes all the features in the mechanical extension devices as described in all the aspect above. Accordingly, the advantages described above for the mechanical extension device also apply equally to the movable seating device that incorporate this type of mechanical extension device.

Other implementation solutions of the disclosure will be apparent to those skilled in the art from consideration of the specification and practice of the disclosure. This application is intended to cover any variations, uses, or adaptations of the disclosure following the general principles thereof and including such departures from the disclosure as come within known or customary practice in the art. It is intended that the specification and examples be considered as exemplary only, with a true scope and spirit of the disclosure being indicated by the following claims.

It will be appreciated that the disclosure is not limited to the exact construction that has been described above and illustrated in the accompanying drawings, and that various modifications and changes may be made without departing from the scope thereof. It is intended that the scope of the disclosure only be limited by the appended claims.

What is claimed is:

1. A seating device, comprising:

an armrest;

a seat;

a backrest;

an ottoman; and a mechanical extension device, comprising:

a seat frame for attaching the seat;

a backrest assembly pivotally connected to a rear part of the seat frame, wherein the backrest assembly comprises a backrest bracket configured to attach a backrest of the seating device; and a leg extension device pivotally connected to a front part of the seat frame, wherein the leg extension device is configured to attach the ottoman, wherein the mechanical extension device is configured to move the seating device from a first position to a second position, wherein the seating device is capable of being in multiple positions comprising a sitting position and a reclining position;

wherein in the sitting position, the ottoman is located under the seat;

wherein in the reclining position, the ottoman extends forward and upward, and the backrest tilts backward;

wherein in the process of moving the seating device from the sitting position to the reclining position, a rear end of the backrest bracket has no backward directional movement; and wherein the backrest assembly comprises a backrest bracket, a first backrest link, and a second backrest link, the first backrest link is pivotally connected to a front end of the backrest bracket at a first pivot point, the first backrest link is pivotally connected to the seat frame at a second pivot point, and the first pivot point has a trajectory that moves towards the leg extension device in the process of moving the seating device from the sitting position to the reclining position.

2. The seating device of claim 1, wherein the second backrest link is a bent piece, wherein the bent piece comprises a third pivot point, a fourth pivot point, and a fifth pivot point, the third pivot point is located on a free end of an upper arm of the bent piece, the fifth pivot point is located on a free end of a lower arm of the bent piece, the fourth pivot point is located between the third and fifth pivot points, the second backrest link is pivotally connected with the rear end of the backrest bracket at the third pivot point, and the second backrest link is pivotally connected with the seat frame at the fourth pivot point, and the fourth pivot point is located further back compared to the second pivot point.

3. The seating device of claim 1, wherein the backrest bracket is coupled to the seat frame through the first backrest link and the second backrest link, an upper end of the first backrest link and the front end of the backrest bracket are pivotally connected at the first pivot point, and a lower end of the first backrest link and the rear part of the seat frame are pivotally connected at the second pivot point.

4. The seating device of claim 3, wherein in process of moving the seating device from the sitting position to the reclining position, the first pivot point has a horizontal motion trajectory towards the leg extension device, and the first pivot point has a vertical motion trajectory that moves downward and then upward.

5. The seating device of claim 3, wherein a distance between the first pivot point and the second pivot point is within a range of 80 mm to 150 mm.

6. The seating device of claim 3, wherein a first angle is formed between the first backrest link and the seat frame in a direction towards the leg extension device, and the first angle is less than 90 degrees, and wherein the first angle is smaller in the reclining position than in the sitting position.

7. The seating device of claim 3, wherein a second angle is formed between the backrest bracket and a horizontal plane in a direction towards the leg extension device, and wherein the second angle increases by at least 20 degrees in the reclining position than in the sitting position.

8. The seating device of claim 2, wherein the mechanical extension device comprises a fixed plate that is fixedly connected to the armrest, wherein in the process of moving the seating device from the seating position to the TV position, a rear end of the seat frame lowers relative to the fixed plate, and wherein in the process of moving the seating device from the TV position to the reclining position, the rear end of the seat frame raises relative to the fixed plate.

9. The seating device of claim 8, wherein the second backrest link is directly or indirectly coupled to the fixed plate at the fifth pivot point.

10. The seating device of claim 8, wherein the seat frame is attached to the fixed plate in a manner that enables the seat frame to move back and forth, through a main linkage and an auxiliary linkage, and wherein the seat frame is pivotally connected to the main linkage, and the auxiliary linkage is pivotally connected to the fixed plate.

11. The seating device of claim 10, wherein the main linkage comprises an intermediate link that is pivotally connected to the auxiliary linkage, wherein in the process of moving the seating device form the seating position to the TV position, the main linkage drives the rear end of the seat frame to move downward and forward relative to the intermediate link, and the intermediate link has no movement relative to the fixed plate, and wherein in the process of moving the seating device form the TV position to the reclining position, the auxiliary linkage drives the seat frame and the main linkage to move forward and upward relative to the fixed plate.

12. The seating device of claim 11, wherein the leg extension device comprises a footrest for attaching the ottoman, and the footrest is raised by 300 mm to 400 mm in the reclining position compared to the sitting position.

13. The seating device of claim 1, wherein the first pivot point is higher in the reclining position than in the sitting position.

14. The seating device of claim 1, wherein the multiple positions further comprise a TV position, and the leg extension device lifts forward and upward in the TV position, and wherein in the process of moving the seating device from the sitting position to the TV position, the first pivot point moves forward and downward, and in the process of moving the seating device from the TV position to the reclining position, the first pivot point moves forward and upward.

15. The seating device of claim 1, wherein the seat frame comprises a stopper located behind the first backrest link, and the stopper supports the first backrest link; and wherein the seating device is an armrest floor-standing seating device.

16. A mechanical extension device, comprising:

a seat frame for attaching a seat of a seating device;

a backrest assembly pivotally connected to a rear part of the seat frame, wherein the backrest assembly comprises a backrest bracket configured to attach a backrest of the seating device; and a leg extension device pivotally connected to a front part of the seat frame, wherein the leg extension device is configured to attach an ottoman of the seating device, wherein the mechanical extension device is configured to move the seating device from a first position to a second position, wherein the seating device is capable of being in multiple positions comprising a sitting position and a reclining position;

wherein in the sitting position, the ottoman is located under the seat;

wherein in the reclining position, the ottoman extends forward and upward, and the backrest tilts backward;

wherein in the process of moving the seating device from the sitting position to the reclining position, a rear end of the backrest bracket has no component that moves backward; and wherein the backrest assembly comprises a backrest bracket, a first backrest link, and a second backrest link, the backrest bracket is configured to attach the backrest, the first backrest link is pivotally connected to a front end of the backrest bracket at a first pivot point, the first backrest link is pivotally connected to the seat frame at a second pivot point, and the first pivot point has a trajectory that moves towards the leg extension device in the process of moving the seating device from the sitting position to the reclining position.

17. The swinging device of claim 16, wherein the second backrest link is a bent piece, wherein the bent piece comprises a third pivot point, a fourth pivot point, and a fifth pivot point, the third pivot point is located on a free end of an upper arm of the bent piece, the fifth pivot point is located on a free end of a lower arm of the bent piece, the fourth pivot point is located between the third and fifth pivot points, the second backrest link is pivotally connected with the rear end of the backrest bracket at the third pivot point, and the second backrest link is pivotally connected with the seat frame at the fourth pivot point, and the fourth pivot point is located further back compared to the second pivot point.

18. The swinging device of claim 16, wherein the backrest bracket is coupled to the seat frame through the first backrest link and the second backrest link, an upper end of the first backrest link and the front end of the backrest bracket are pivotally connected at the first pivot point, and a lower end of the first backrest link and the rear part of the seat frame are pivotally connected at the second pivot point.

19. The swinging device of claim 18, wherein in process of moving the seating device from the sitting position to the reclining position, the first pivot point has a horizontal motion trajectory towards the leg extension device, and the first pivot point has a vertical motion trajectory that moves downward and then upward.

20. The swinging device of claim 18, a distance between the first pivot point and the second pivot point is within a range of 80 mm to 150 mm.

* * * * *